US010335807B2

(12) United States Patent
Butzke et al.

(10) Patent No.: US 10,335,807 B2
(45) Date of Patent: Jul. 2, 2019

(54) SHOWER HEAD

(71) Applicant: Hansgrohe SE, Schiltach (DE)

(72) Inventors: Klaus Butzke, Schiltach (DE); Marc Kalmbach, Aichhalden (DE)

(73) Assignee: Hansgrohe SE, Schiltach (DE)

( * ) Notice: Subject to any disclaimer, the term of this patent is extended or adjusted under 35 U.S.C. 154(b) by 0 days.

(21) Appl. No.: 15/363,801

(22) Filed: Nov. 29, 2016

(65) Prior Publication Data

US 2017/0157627 A1 Jun. 8, 2017

(30) Foreign Application Priority Data

Dec. 2, 2015 (DE) ..... 10 2015 224 107

(51) Int. Cl.

| | |
|---|---|
| ***B05B 1/02*** | (2006.01) |
| ***B05B 1/16*** | (2006.01) |
| ***B05B 1/18*** | (2006.01) |
| ***B05B 15/50*** | (2018.01) |
| ***B05B 15/65*** | (2018.01) |

(52) U.S. Cl.

CPC ..... *B05B 1/185* (2013.01); *B05B 1/02* (2013.01); *B05B 1/169* (2013.01); *B05B 15/65* (2018.02); *B05B 15/50* (2018.02)

(58) Field of Classification Search

CPC .. B05B 1/02; B05B 1/169; B05B 1/18; B05B 1/185; B05B 1/14; B05B 1/16; B05B 15/02; B05B 15/065

See application file for complete search history.

(56) References Cited

U.S. PATENT DOCUMENTS

| | | | | |
|---|---|---|---|---|
| 2,949,240 | A * | 8/1960 | Koolnis | A61H 9/00 239/200 |
| 7,896,266 | B1 * | 3/2011 | Cooper | B05B 9/007 239/754 |
| 8,096,488 | B2 * | 1/2012 | Mueller | B05B 1/1663 239/289 |
| 2013/0291298 | A1 | 11/2013 | Zhou et al. | |

FOREIGN PATENT DOCUMENTS

| | | | |
|---|---|---|---|
| CN | 2778395 | Y | 5/2006 |
| DE | 10231839 | A1 | 1/2004 |
| DE | 102011051864 | A1 | 1/2013 |
| DE | 102013224054 | B3 | 1/2015 |
| DE | 102013224051 | A1 | 5/2015 |

OTHER PUBLICATIONS

Search Report dated Apr. 12, 2017 in EP Application 16200186.1-1760.

* cited by examiner

*Primary Examiner* — Christopher S Kim
(74) *Attorney, Agent, or Firm* — Duane Morris LLP

(57) ABSTRACT

A shower head comprising has a shower base body (2') and a jet disk structure (3) disposed on the shower base body. The jet disk structure (3) includes plural jet disk elements (4) that are individually and detachably fixable to the shower base body (2) and each forms a partial jet disk surface (5) of a total jet disk surface. Furthermore, the shower base body has a distinct fluid supply (7) for each of the jet disk elements. The structure can be embodied, for example, as a shower-bath shower head, in particular for an overhead, hand-held and/or side shower, for providing a water jet.

9 Claims, 3 Drawing Sheets

SHOWER HEAD

The invention relates to a shower head, in particular for a sanitary shower device, having a shower base body and a jet disk structure that is disposed on the shower base body.

The shower head may be a douche shower head, for example, in particular a head shower, a hand shower, and/or a lateral shower for providing a douche jet.

A shower functional group having a shower head housing and a manifold plate in the shower head housing is known from the unexamined and first publication DE 10 2013 224 051 A1, to which one of a plurality of dissimilar jet disks may be selectively fitted.

The invention is based on the technical object of providing a shower head of the type mentioned at the outset which improves the prior art and, in particular, enables great functionality and at the same time simple operability.

The invention achieves this object by providing a shower head having the features of claim 1.

In the case of the shower head according to the invention, the jet disk structure includes a plurality of jet disk elements. The jet disk elements are individually and detachably fixable to the shower base body. This is to be understood to mean that the shower base body and the jet disk elements are adapted and specified for being able to attach the jet disk elements repeatedly and in a non-destructive manner on the shower base body in the course of normal usage. Furthermore, the jet disk elements each form a partial jet disk surface of a total jet disk surface. The partial jet disk surfaces may also be referred to as partial jet exit surfaces, and the total jet disk surface may also be referred to as a total jet exit surface. Furthermore, the shower base body has a distinct fluid supply for each of the jet disk elements.

The shower head allows for the respective jet disk element to be individually detached or replaced, for example for cleaning in the case of calcification or contamination, while the remaining jet disk element or elements remain fixed to the shower base body and during use may further be supplied with fluid by means of the respective assigned fluid supply of the former. The removed jet disk element may thus by cleaned or descaled without disassembling the jet disk structure. Moreover, the invention enables a flexible employment on demand of jet disk elements of dissimilar jet types, so as to accordingly achieve dissimilar jet characteristics of the total jet disk surface in a variable way.

Each of the plurality of fluid supplies upon fixing to the shower base body may achieve a direct or indirect fluid connection, in particular by means of one or a plurality of fluid ducts, from a fluid inlet of the shower base body to a fluid outlet of the assigned jet disk element.

The total jet disk surface may furthermore at least in portions be planar. Alternatively or additionally, the total jet disk surface may at least in portions be curved in a convex or concave manner. In particular, the total jet disk surface may be configured in such a manner that individual fluid jets from the plurality of partial jet disk surfaces exit beside one another in approximately the same direction from the shower head, forming a uniform total fluid jet.

Depending on requirements, for example two, three, or more jet disk elements, in particular also seven or even more, may be provided. Furthermore, at least one, in particular each, of the jet disk elements may have a shape of a sector, a fragment, or a segment of a circle. A plurality of such jet disk elements may then be disposed beside one another, so as to be mutually adjacent, around a jet disk surface axis that is defined by the total jet disk surface, and the total jet disk surface may have a circular shape. Alternatively or additionally, at least one, in particular each, of the jet disk elements may have a rectangular shape. A plurality of such jet disk elements may then be disposed so as to be mutually adjacent, and the total jet disk surface may have a rectangular shape. Adjacent, or beside one another, respectively, means that the jet disk elements are disposed contiguously without any gap, or that a spacing between two jet disk elements is less than a predefined value, for example less than 0.5 cm, or less than 0.1 cm.

In one refinement of the invention the shower base body has a dedicated shut-off valve for at least one of the fluid supplies, in particular a dedicated shut-off valve for each of the fluid supplies. The shut-off valve is configured so as to be adjustable between an enable position, i.e. open position, for the assigned fluid supply when the disk jet element is fixed to the shower base body, and a shut-off position, i.e. closed position, for the fluid supply when the disk jet element is detached from the shower base body. In the case of a shut-off valve that is adjusted to the enable position thereof, fluid may flow through the fluid supply or exit from the latter during use. In the case of a shut-off valve that is adjusted to the shut-off position thereof, no fluid may flow through the fluid supply. In the case of a jet disk element that is detached from the shower base body, the shut-off valve enables ongoing use of the shower head according to the intended purpose by way of the remaining jet disk elements that are fixed to the shower base body, for example while the detached jet disk element is being cleaned.

Advantageously, the shut-off valve may have an operating element for the user to adjust the shut-off valve. As an alternative to an operating element, the shut-off valve may be configured for adjusting to the enable position thereof in a self-acting manner by fixing or attaching the assigned jet disk element to the shower base body, and for adjusting to the shut-off position thereof in a self-acting manner by detaching the jet disk element from the shower base body. Thus, just fixing or detaching of the jet disk element may suffice for adjusting the shut-off valve, allowing intuitive and simple operation of the shower head. In particular, the shower head in one design embodiment of the invention comprises a mechanical coupling between the shut-off valve and the assigned jet disk element, wherein the mechanical coupling is configured for adjusting the shut-off valve by the jet disk element.

In one refinement of the invention, the shower head comprises an in particular self-locking snap mechanism. The latter is configured for detachable fixing of at least one, in particular each, of the plurality of jet disk elements to the shower base body, and is configured so as to be operable by pushing in an attachment direction of the jet disk element.

The attachment direction is that direction in which the jet disk element is moved in relation to the shower base body, chiefly when being fixed or attached to the latter. The snap mechanism allows for the jet disk element to be fixed to the shower base body just by pushing in the attachment direction and letting go, and for the fixation to the shower base body to be detached by pushing once more and letting go of the jet disk element. The snap mechanism may additionally be configured for moving or ejecting the detached jet disk element away from the shower body. Thus, fixing and detaching the jet disk element to and from the shower base body is possible in a tool-free manner. In particular, the snap mechanism upon fixing may form a form-fitting connection between the shower base body and the jet disk element. The snap mechanism may correspond to a mechanism for fixing an SD card in an SD card slot such as in a digital camera, for example.

In one refinement of the invention, the attachment direction of at least one, in particular of each, of the plurality of jet disk elements runs parallel with a jet disk surface axis. The jet disk surface axis may run perpendicularly to the total jet disk surface. Thus, the jet disk element by way of a rear side that is opposite the partial jet disk surface upon fixing may be moved toward a bottom side of the shower base body. In particular, the bottom side of the shower base body may form a stop limit for moving the jet disk element toward the shower base body. Additionally or alternatively, the snap mechanism that is operable by pushing in the attachment direction, if and when present, may be disposed on the rear side of the jet disk element and/or on the bottom side of the shower base body. Furthermore additionally or alternatively, the mechanical coupling between the shut-off valve and the assigned jet disk element, if and when present, may be disposed on the bottom side of the shower base body and/or on the rear side of the jet disk element. Upon subsequent detaching, the jet disk element may then simply be moved away or retrieved in a downward fashion from the shower base body.

In one design embodiment of the invention, the shower base body has a safeguard for fixing the respective jet disk element to the shower base body perpendicular, in particular in the radial direction, to the jet disk surface axis. Thus, the jet disk element is not only fixed in or counter to the attachment direction, but also in a manner perpendicular thereto. To this end, the safeguard may comprise a separate element in the form of an external ring that fixes the jet disk element so as to be away from the jet disk surface axis in the radial direction. Additionally or alternatively, the safeguard may comprise a separate element in the form of an internal body which fixes the jet disk element in relation to the let disk surface axis in the radial direction.

In one refinement of the invention, at least one, in particular each, of the plurality of fluid supplies is disposed on the bottom side of the shower base body. Advantageously, the fluid supply, when the jet disk element is fixed to the shower base body, may open into said jet disk element at the rear side that lies opposite the partial jet disk surface. This arrangement allows a particularly simple structure of the shower base body.

In one refinement of the invention, at least one of the plurality of jet disk elements is configured as a hollow body having a fluid chamber. The fluid chamber, on the one hand, is in fluid communication with the assigned fluid supply, when the jet disk element is fixed or attached to the shower base body, and on the other hand is in fluid communication with a fluid outlet in the partial jet disk surface. Apart therefrom, the hollow body may be fluid tight. In order for the jet disk element and/or the shower base body to be sealed, a relatively small seal such as, for example, a relatively small annular seal that is disposed on the fluid supply may suffice such that no fluid from the fluid supply leaks past the assigned jet disk element to the outside.

In one refinement of the invention, at least two of the plurality of jet disk elements differ in a number, an arrangement, a shape, and/or a size, or diameter, respectively, of fluid outlets in the respective partial jet disk surfaces, and are designed for providing different types of fluid jets. The types of fluid lets may comprise, for example, a hard jet, or a massaging jet, respectively, a surge jet, and/or a normal jet. The user, by selecting from the different jet disk elements and by fixing the latter to the shower base body, may implement different jet exit patterns or jet exit characteristics of a fluid jet so as to correspond to said user's desires or requirements.

Advantageous embodiments of the invention are illustrated in the drawings, and will be described hereunder. In the drawings.

Figure 1:
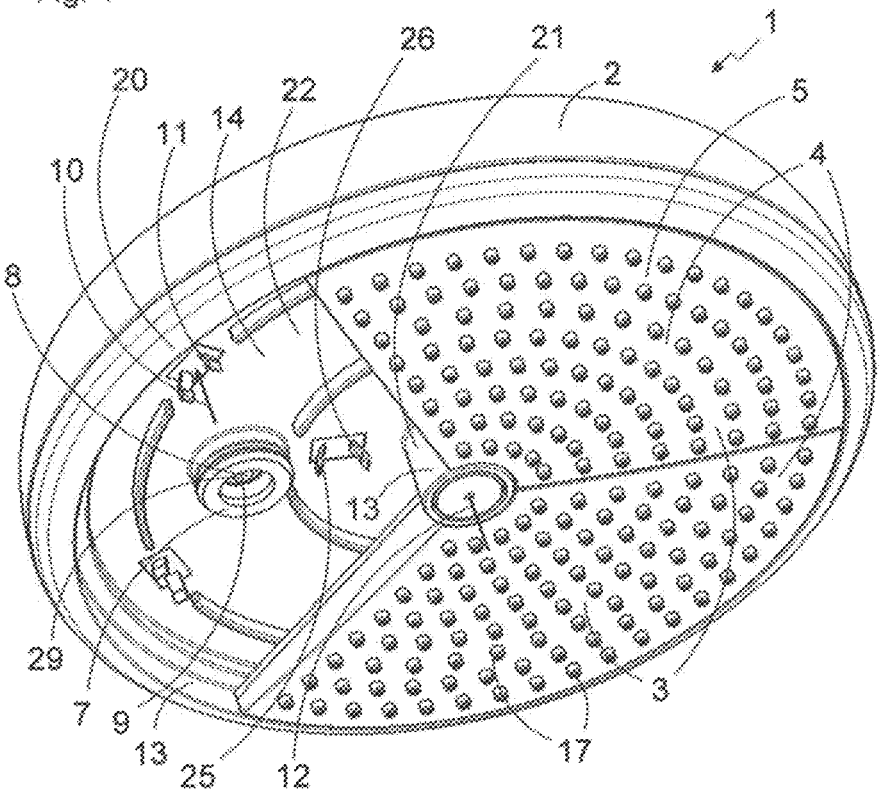
FIG. 1 shows a perspective view of a shower head having a shower base body and a plurality of jet disk elements fixed to the latter.
Figure 2:
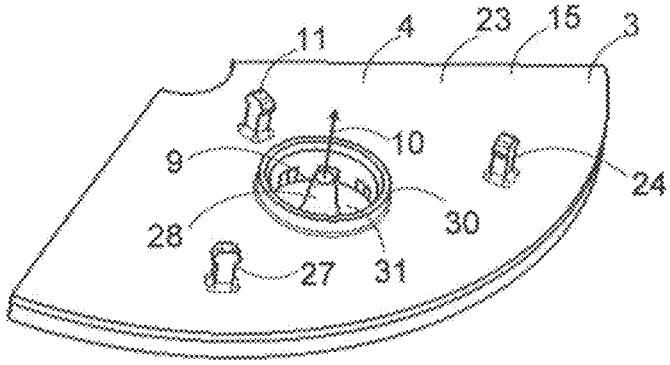
FIG. 2 shows a perspective view of a jet disk element of the shower head of FIG. 1 that has been detached from the shower base body.

A shower head 1, shown in FIG. 1, for a sanitary shower device, comprises a shower base body 2 and a jet disk structure 3 that is disposed on the shower base body 2. The jet disk structure 3 per se comprises a plurality of discrete jet disk elements 4, in the present embodiment three thereof, wherein two jet disk elements 4 are shown in FIG. 1, and one further jet disk element 4 is shown in FIG. 2. The jet disk elements 4 are individually and, so as to be detached in a non-destructive manner, fixable to the shower base body 2. In FIG. 1, the two jet disk elements 4 are fixed to the shower base body 2, and in FIG. 2, the jet disk element 4 is detached from the shower base body 2. If and when all three jet disk elements 4 of the jet disk structure 3 are fixed to the shower base body 2, the jet disk elements 4 each form one partial jet disk surface 5 of a total jet disk surface, as is derived by the corresponding completion based on FIG. 1. Furthermore, the shower base body 2 for each of the jet disk elements 4 has a dedicated fluid supply 7, wherein the fluid supply 7 for the jet disk element 4 that is shown in FIG. 2 and is detached from the shower base body 2 can be seen in FIG. 1.

The shower base body 2 has a usual fluid inlet (not shown) into the shower head 1. Furthermore, each of the jet disk elements 4 comprises one fluid outlet 17 in the form of a plurality of water exit openings 10 from the shower head 1 in the partial jet disk surface 5 of the former. Each fluid supply 7 achieves a fluid connection from the fluid inlet to the fluid outlet 17 of the assigned jet disk element 4 when the jet disk element 4 is fixed to the shower base body 2. Moreover, 15 the jet disk elements 4 are fluidically separated from one another, that is to say that none of the jet disk elements 4 has a direct fluid connection with the other jet disk elements 4.

Figure 4:
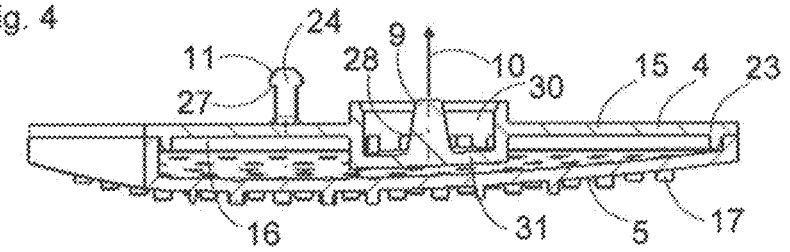
FIG. 4 shows a sectional view of the jet disk element of FIG. 2, along a section line IV-IV in FIG. 3.

The total jet disk surface of the shower head 1 is outwardly curved in a convex manner, that is to say downward in FIGS. 1 and 4. Furthermore, the total jet disk surface in the example shown is of circular shape and is configured in such a manner that individual fluid jets of the plurality of partial jet disk surfaces 5 during use exit from the shower head 1 beside one another so as to be in approximately the same direction, forming a uniform, homogeneous total fluid jet. In detail, each of the jet disk elements 4 has a shape of a sector, a fragment, or a segment of a circle. The total jet disk surface defines a jet disk surface axis 12 which runs perpendicularly to the total jet disk surface. The jet disk elements 4 are disposed so as to be mutually adjacent about the jet disk surface axis 12. There is no gap, or at maximum a small gap of which the width is less than 0.5 cm, preferably less than 0.1 cm, and larger than a production tolerance of the components of the shower head 1, between each two adjacent jet disk elements 4.

The shower base body 2 has a circular cylindrical shape having a cylindrical internal body 21 and an appendage of the sleeve face in the form of an external ring 20. On account thereof, the shower head 1 forms a cylindrical or annular receptacle space 22 for the jet disk structure 3, that is to say for the jet disk elements 4 thereof. If and when all jet disk elements 4 are fixed to the shower base body 2, the total jet disk surface, the external ring 20, and the internal body 21 form a flush stepless surface.

An attachment direction 10 of the jet disk elements 4 runs parallel with the jet disk surface axis 12, from bottom to top in FIG. 1. When one of the jet disk elements 4 is fixed, the latter by way of a rear side 23 that lies opposite a partial jet disk surface 5 is moved toward a lower end side in FIG. 1 or a bottom side 14 of the shower base body 2, and into the receptacle space 22. Herein, the bottom side 14 forms a stop limit for moving the jet disk element 4 into the receptacle space 22. If and when the jet disk element 4 is attached, the former by way of a rear side 23 thereof bears on the bottom side 14 of the shower base body 2. When the jet disk element 4 is subsequently detached, the latter in FIG. 1 is moved downward away from the shower base body 2, and is retrieved from the receptacle space 22.

The shower head 1 furthermore comprises a snap mechanism 11 that is operable by pushing in the attachment direction 10 and that is configured for detachably fixing each of the plurality of jet disk elements 4 to the shower base body 2. The snap mechanism 11 is disposed between or on the bottom side 14 of the shower base body 2 and the rear side 23 of the respective jet disk element 3, as can be seen in FIGS. 1 to 4. The snap mechanism 11 secures the jet disk elements 4 in the direction that is counter to the attachment direction 10 from being detached from the shower base body 10. Said snap mechanism 11 allows for the respective jet disk element 4 to be fixed to the shower base body 10 just by pushing in the attachment direction 10 and letting go, and for the fixation to the shower base body 2 to be detached again by pushing once more and letting go of the jet disk element 4. Additionally, the snap mechanism 11 is configured for moving the detached jet disk element 4 downward away from the shower body 2 in FIG. 1, or for ejecting said detached jet disk element 4 from the receptacle space 22.

In detail, the snap mechanism 11 for each jet disk element 4 comprises three rigid latching appendages 24 which are disposed on the rear side 23 of the respective jet disk element 4, and three corresponding flexible latching-arm pairs 25 which are disposed on the bottom side 14 of the shower base body 2. When a respective jet disk element 4 is fixed or attached to the shower base body 2, the flexible latching-arm pairs 25 by way of latching cams 26 engage in latching spaces 27 on the rigid latching appendages 24. The snap mechanism 11 thus forms a form-fitting connection between the shower base body 2 and the respective jet disk element 4. Upon renewed movement of the jet disk element 4 in the attachment direction 10, the flexible latching-arm pairs 25 jump away from the rigid latching appendages 24, and the latching cams 26 move out of the latching spaces 27. The form-fitting connection between the shower base body 2 and the respective jet disk element 4 is thus detached.

In order for the respective jet disk element 4 to be fixed perpendicularly, in particular in the radial direction, to the jet disk surface axis 12 on the shower base body 2, the shower base body 2 has a safeguard 13. In detail, the safeguard 13 comprises the external ring 20 which on the circumferential side surrounds the fixed or attached jet disk elements 4, thus fixing the latter away from the jet disk surface axis 12 in the radial direction. Furthermore, the safeguard 13 comprises the internal body 21 which fixes the attached jet disk elements 4 in relation to the jet disk surface axis 12 in the radial direction. Additionally, the snap mechanism 11 secures the fixed jet disk elements 4 in the radial direction and the rotation direction about the jet disk surface axis 12.

The fluid supplies 7 are disposed on the bottom side 14 of the shower base body 2. From there, said fluid supplies 7 lead to the rear sides 23 of fixed jet disk elements 4 and open into the latter. The fluid supplies 7 also secure their respective assigned jet disk element 4 in a manner perpendicular to the jet disk surface axis 12. The shower base body 12 has a dedicated shut-off valve 8 for each fluid supply 7. Each shut-off valve 8 is configured so as to be adjustable between an enable position for the assigned fluid supply 7 when the jet disk element 4 is fixed to the shower base body 2, and a shut-off position for the fluid supply 7 when the jet disk element 4 is detached from the shower base body 2. If and when one of the shut-off valves 8 is adjusted to the enable position thereof, the former during use enables a fluid flow through the fluid supply 7 to the assigned jet disk element 4. If and when the shut-off valve 8 is adjusted to the shut-off position thereof, the former shuts off this fluid flow through the fluid 7 to the assigned jet disk element 4. In the case of one of the plurality of jet disk elements 4 being detached from the shower base body 2 and being cleaned, for example, the shut-off valves 8 enable ongoing use of the shower head 1 according to the intended purpose by way of the remaining jet disk elements 4 that are fixed to the shower base body 2.

Furthermore, the shower head 1 comprises a mechanical coupling 9 between each of the plurality of shut-off valves 8 and the jet disk element 4 assigned thereto, said mechanical coupling 9 being configured for adjusting the shut-off valve 8 by the jet disk element 4. Just fastening or detaching one of the plurality of jet disk elements 4 thus suffices for adjusting the assigned shut-off valve 8. The mechanical couplings 9 are disposed between or on the bottom side 14 of the shower base body 2 and the rear sides 23 of the jet disk elements 4.

In the example shown, each of the mechanical couplings 9 comprises a coupling pin 28 which is disposed on the rear side 23 of the respective jet disk element 4, projecting from the latter in the attachment direction 10. The assigned shut-off valve 8 comprises a valve closing body 29 which is adjustable along the attachment direction 10 between an enable position and a shut-off position. If and when the assigned jet disk element 4 is detached form the shower base body 2, the valve closing body 29 in the shut-off position thereof, at least during use of the shower head 1, is impinged by a force counter to the attachment direction 10. If and when the jet disk element 4 is being fixed or is fixed to the shower base body 2, the coupling pin 28 urges the valve closing body 29 to the enable position, or holds said closing body 29 in the latter.

The jet disk elements 4 are configured as hollow bodies 15 having a fluid chamber 16, as can be seen in FIG. 4. On the one hand, the fluid chamber is in fluid connection with the assigned fluid supply 7, when the jet disk element 4 is fixed or attached to the shower base body 2, and on the other hand is in fluid connection with the fluid outlet 17 in the partial jet disk surface 5. Apart therefrom, the hollow body 15 is fluid tight. Furthermore, the shower head 1 for each fluid supply 7 or each jet disk element 4 comprises one seal such that during use no fluid from the fluid supply 7 may flow past the assigned jet disk element 4 to the outside, but may flow only through the hollow body 15.

Figure 3:
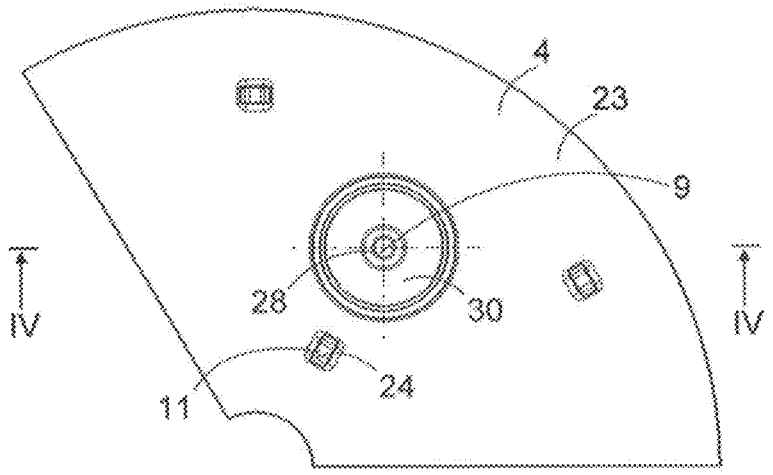
FIG. 3 shows a plan view of a rear side of the jet disk element of FIG. 2.

In detail, the hollow body 15 on the rear side 23 has a fluid entry region 30, as can be seen in FIGS. 2 to 4. When the jet disk element 4 is fixed to the shower base body 2, the assigned fluid supply 7 opens into the fluid entry region 30. Furthermore, the fluid entry region 30 is in fluid connection with the fluid chamber 16. A flow deflection contour or surface 31 is disposed on the downstream end of the fluid entry region 30. The flow deflection contour 31 is configured for deflecting the flow of fluid, in particular by at least 90°, from the fluid supply 7 into the fluid chamber 16. In this way, a uniform distribution of fluid in the fluid chamber 16, and consequently a uniform outflow of fluid from the fluid outlet 17 in the form of a shower fluid jet that corresponds to the water exit openings of the jet disk element 4 is achieved.

FIGS. 5 to 7 and 8 each show one further shower head 1' according to the invention, wherein for the sake of clarity not only identical but also functionally equivalent elements are provided with the same reference numerals as in the embodiment explained above, to the description of which reference is made to this extent. By contrast to the jet disk structure 3 of the embodiment of FIGS. 1 to 4, the exemplary embodiment of FIGS. 5 to 7 comprises a jet disk structure 3' having seven jet disk elements 4*a*'. Furthermore, a total jet disk surface 6' which is formed from partial jet disk surfaces 5*a*', 5*b*' of the jet disk elements 4*a*', 4*b*' that are individually and detachably fixable to the shower base body 2' is planar.

Figure 5:
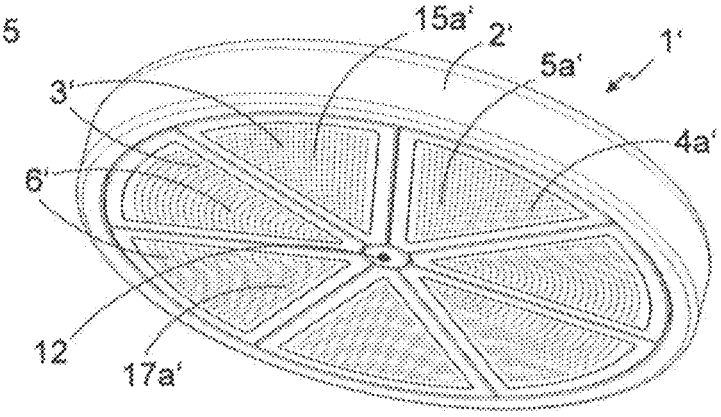
FIG. 5 shows a perspective view of an alternative embodiment of a shower head having a shower base body and a plurality of jet disk elements.
Figure 6:
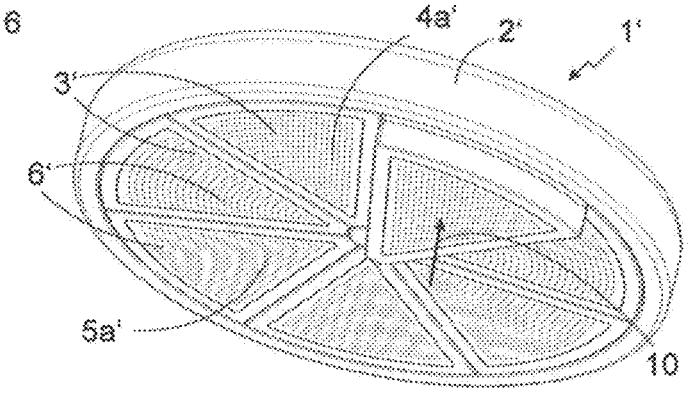
FIG. 6 shows a perspective view of the shower head of FIG. 5, one of the plurality of jet disk elements being detached from the shower base body.
Figure 7:
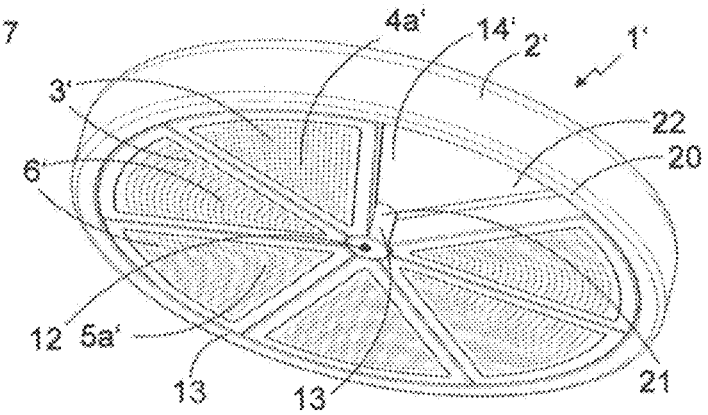
FIG. 7 shows a perspective view of the shower head of FIG. 5, without the detached jet disk element of FIG. 6.

It can be seen in FIGS. 5 to 7 how one of the plurality of jet disk elements 4*a*' is successively detached and removed from the shower base body 2' counter to the attachment direction 10. For the sake of simplicity, the fluid supply and the snap mechanism on a bottom side 14' of the shower base body 2' are not shown in FIG. 7.

Figure 8:
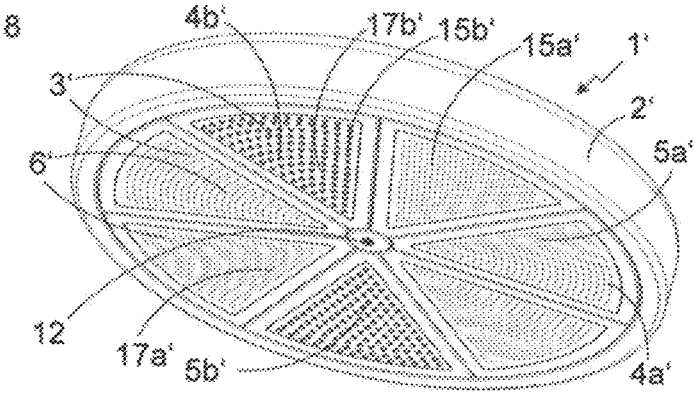
FIG. 8 shows a perspective view of the shower head of FIG. 5, in a variant having different jet disk elements.

In the exemplary embodiment of FIG. 8, the jet disk structure 3' comprises five jet disk elements 4' of identical type, and two jet disk elements 4*b*' that are different therefrom. The fluid outlets 17*a*' of the jet disk elements 4' differ from the fluid outlets 17*b*' of the jet disk elements 4*b*' in a number, arrangement, and/or size of water exit openings, and are configured for providing dissimilar types of fluid jets. In other embodiments, any arbitrary other combinations of jet disk elements each having an associated type of jet may be employed for forming the total jet disk surface. In further alternative embodiments (not shown) of the invention, the jet disk structure comprises four, five, six, eight, nine, or at least ten jet disk elements, and/or the total jet disk surface is curved inwardly in a concave manner.

In the embodiments shown, the jet disk elements each have a shape of a sector, a fragment, or a segment of a circle, and the total jet disk surface has a circular shape. Alternatively, at least one, in particular each, of the jet disk elements may have another shape. In this way, each of the jet disk elements may have a rectangular shape, for example. The jet disk elements may then be disposed so as to be mutually adjacent, and the total jet disk surface may have a rectangular shape. Furthermore, the jet disk elements in the embodiments shown are disposed directly beside one another. Alternatively, the jet disk elements may have a mutual spacing of up to a few centimeters, for example 1 cm to 2 cm. Furthermore, the shower base body in the embodiments shown has a circular cylindrical shape. Alternatively, the shower base body may have another shape that in particular may correspond to the shape of the let disk structure or to the total jet disk surface.

Furthermore, the attachment direction in the embodiments shown runs parallel with the let disk surface axis. In one alternative embodiment, the attachment direction may run so as to not be parallel with the jet disk surface axis, in particular so as to be perpendicular thereto. The shower base body and the jet disk elements may be correspondingly altered. In particular, the snap mechanism may be disposed at another location. Also, latching appendages may be disposed on the shower base body, and flexible latching-arm pairs may be disposed on the let disk elements. The fluid supplies may be disposed at another location, in particular on the external ring and/or on the internal body, in a manner independent from the attachment direction.

In the embodiments shown, the respective shower head has the mechanical coupling. Alternatively or additionally, the shower head may have another type of coupling, for example a magnetic coupling which is configured for adjusting the shut-off valve by way of the jet disk element. Furthermore alternatively or additionally, the coupling may be omitted for at least one of the shut-off valves, and the shut-off valve may be assigned a user-operable operating element for adjusting the shut-off valve.

Furthermore, the jet disk elements in the embodiments shown each are configured as a hollow body. Alternatively or additionally, at least one of the plurality of jet disk elements may be configured as an open plate.

As is highlighted by the embodiments shown and explained above, the invention provides an advantageous shower head which improves the prior art and, in particular, enables ready detaching of individual jet disk elements from the shower base body, or replacing said individual jet disk elements, wherein the shower head may be utilized in an ongoing manner according to the intended purpose.

The invention claimed is:

1. A shower head comprising:

a shower base body and a jet disk structure disposed on the shower base body; wherein the jet disk structure includes a plurality of jet disk elements, each of said jet disk elements being individually and detachably fixable to the shower base body, each of said jet disk elements having fluid exit openings for fluid outlet and forming a partial jet disk surface of a total jet disk surface, wherein the partial jet disk surfaces of said jet disk elements, but for the fluid exit openings, together form the total jet disk surface as a flush stepless surface on a jet exit side thereof;

the shower base body contains a distinct fluid supply corresponding to each of the jet disk elements;

the shower base body contains a shut-off valve assigned to each of a plurality of the distinct fluid supplies, wherein the shut-off valve assigned to said at least one of the distinct fluid supplies has an enable position for the assigned fluid supply, opening said shut-off valve due to one of the jet disk elements corresponding to the assigned fluid supply becoming fixed to the shower base body, and a shut-off position for the assigned fluid supply, closing said shut-off valve due to said jet disk element corresponding to the assigned fluid supply becoming detached from the shower base body; and each of the plurality of jet disk elements is a hollow body containing a fluid chamber, which fluid chamber is in fluid communication with the fluid supply assigned to the shut-off valve when the jet disk element is fixed to the shower base body, and is in fluid communication with a fluid outlet in the partial jet disk surface, the assigned fluid-supply entering into said chamber on a rear side of the corresponding jet disk element.

2. The shower head according to claim 1, further comprising a mechanical coupling between the shut-off valve assigned to said one of the distinct fluid supplies and the jet disk element corresponding to said one of the distinct fluid supplies, which mechanical coupling is configured for adjusting the shut-off valve when fixing and detaching the jet disk element to and from the shower base body.

3. The shower head according to claim 1, further comprising a snap-mechanism which is configured for detachable fixing of at least one of the plurality of jet disk elements to the shower base body and is disposed to be operable by pushing in an attachment direction of the jet disk element.

4. The shower head according to claim 1, wherein an attachment direction of the jet disk element corresponding to said one of the distinct fluid supplies extends in parallel to a jet disk surface axis.

5. The shower head according to claim 4, wherein the shower base body includes a safeguard for fixing said jet disk element corresponding to said one of the distinct fluid supplies to the shower base body perpendicular to the jet disk surface axis.

6. The shower head according to claim 1, wherein at least one of the plurality of fluid supplies is disposed on a bottom side of the shower base body.

7. The shower head according to claim 1, wherein at least two of the plurality of jet disk elements differ in at least one of a number, an arrangement, a shape and a size of said fluid outlet in the respective partial jet disk surfaces of said at least two of the plurality of jet disk elements.

8. A sanitary shower device comprising a shower head, said shower head comprising a shower base body and a jet disk structure disposed on the shower base body, wherein the jet disk structure includes a plurality of jet disk elements, each of said jet disk elements being individually and detachably fixable to the shower base body, each of said jet disk elements having fluid exit openings for fluid outlet and forming a partial jet disk surface of a total jet disk surface, wherein the partial jet disk surfaces of said jet disk elements, but for the fluid exit openings, together form the total jet disk surface as a flush stepless surface on a jet exit side thereof;

the shower base body contains a distinct fluid supply for each of the jet disk elements;

the shower base body contains a shut-off valve for at least one of the fluid supplies corresponding to a jet disk element to which the shut-off valve and said at least one of the fluid supplies are assigned, which shut-off valve changes between an enable position opening said at least one of the fluid supplies into the assigned jet disk element when the jet disk element corresponding thereto is fixed to the shower base body, and a shut-off position closing said at least one of the fluid supplies into the assigned jet disk element when said jet disk element corresponding thereto is detached from the shower base body; and at least one of the plurality of jet disk elements is a hollow body having a fluid chamber, which chamber is in fluid communication with the assigned fluid supply when the jet disk element assigned to the assigned fluid supply is fixed to the shower base body, and emits through a fluid outlet in the partial jet disk surface of the jet disk element assigned to the assigned fluid supply, the assigned fluid-supply entering into said fluid chamber on a rear side of the jet disk element assigned to the fluid supply.

9. A shower head comprising:

a shower base body and a jet disk structure that has a plurality of jet disk elements, each of the jet disk elements having fluid exit openings for fluid outlet and occupying a partial jet disk surface of a total jet disk surface of the jet disk structure, wherein the partial jet disk surfaces of said jet disk elements, but for the fluid exit openings, together form the total jet disk surface as a flush stepless surface on a jet exit side thereof;

wherein each respective jet disk element of the plurality of jet disk elements is individually attachable to the shower base body to establish flow from one of a plurality of fluid supplies in the shower base body that is assigned to the partial disk surface and establishes flow to said respective jet disk element when attached to the shower base body at the partial disk surface;

wherein each said respective jet disk element couples to said one of the fluid supplies through a shut-off valve contained in the shower base body;

wherein the shut-off valve is individually opened by attachment of the respective one of the jet disk elements to the shower base body and is individually closed by removal of said respective one of the jet disk elements from the shower base body; and, wherein each respective one of said jet disk elements contains a fluid chamber that couples on a rear side of the respective said jet disk element through the shut-off valve, to the corresponding one of the distinct fluid supplies, and wherein the fluid chamber opens on a front side of the respective said jet disk element, for emission of a fluid spray from the assigned one of the fluid supplies when the respective said disk element is attached to the shower base body.

* * * * *